US008500493B2

(12) United States Patent
Liu et al.

(10) Patent No.: US 8,500,493 B2
(45) Date of Patent: Aug. 6, 2013

(54) ELECTRICAL CONNECTOR WITH IMPROVED METAL SHELL

(75) Inventors: Hao Liu, Kunshan (CN); Zi-Qiang Zhu, Kunshan (CN); Jia-Wei Gu, Kunshan (CN); Bo Yang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 270 days.

(21) Appl. No.: 13/013,023

(22) Filed: Jan. 25, 2011

(65) Prior Publication Data

US 2011/0183548 A1 Jul. 28, 2011

(51) Int. Cl.
*H01R 24/00* (2011.01)

(52) U.S. Cl.
USPC ..... 439/660; 439/607.01

(58) Field of Classification Search
USPC ..... 439/76.1, 608, 607.35, 660, 607.01
See application file for complete search history.

(56) References Cited

U.S. PATENT DOCUMENTS

| | | | | |
|---|---|---|---|---|
| 7,857,665 | B2 * | 12/2010 | Xiong et al. | 439/660 |
| 8,038,480 | B2 * | 10/2011 | Wei | 439/660 |
| 2005/0064747 | A1 * | 3/2005 | Xue et al. | 439/150 |
| 2006/0141845 | A1 * | 6/2006 | Hu et al. | 439/350 |
| 2007/0287330 | A1 * | 12/2007 | Chien et al. | 439/607 |

FOREIGN PATENT DOCUMENTS

| | | | |
|---|---|---|---|
| CN | 201285876 | Y | 8/2008 |

* cited by examiner

*Primary Examiner* — Truc Nguyen
(74) *Attorney, Agent, or Firm* — Wei Te Chung; Ming Chieh Chang

(57) ABSTRACT

An electrical connector includes an insulative housing, a plurality of terminals retained in insulative housing, and a metal shell covering the insulative housing and including an inner side wall, a rear wall spaced from the inner side wall along a front-to-back direction, and an outer side wall bent forwardly from an outer side of the rear wall. The inner side wall defines an opening, and an inclined extensive plate extending forwardly and outwardly from an edge of the opening. The outer side wall has a retaining hole, and a front plate enclosing a front side of the retaining hole. The extensive plate has a hook bending inwardly and hitching the front plate after the hook passes through the retaining hole for preventing the outer side wall from moving forwardly and overly.

12 Claims, 8 Drawing Sheets

ELECTRICAL CONNECTOR WITH IMPROVED METAL SHELL

BACKGROUND OF THE INVENTION

1. Field of the Invention

The present invention relates to an electrical connector, more particularly to an electrical connectors having improved a metal shell.

2. Description of Related Art

Electrical connectors have been employed to be mounted onto a printed circuit board in various electronic components associated with a computer, such as a hard disk drive, a printer, etc. Such an electrical connector usually includes an insulative housing, a plurality of terminals retained in the insulative housing and soldered on the printed circuit board, and a metal shell covering the insulative housing. The metal shell includes a top wall, a pair of inner side walls bent downwardly and vertically from two opposite sides of the top wall, a rear wall bent downwardly from a rear end of the top wall, and a pair of outer side walls bent forwardly from two opposite sides of the rear wall. The inner side walls each defines a first opening passing therethrough, and a locking plate extending forwardly and outwardly from a rear edge of the first opening. The outer side walls each defines a second opening and a front plate enclosing a front side of the second opening. The locking plate is received in the second opening and abuts forwardly and inwardly against the front plate to prevent the rear wall from moving rearwardly. However, After the outer side wall has been assembled with the inner side wall, the rear wall and the outer side walls are movable along a front-to-back direction. When the rear wall is hit by an external object by mistake, the rear wall and the outer side wall moves forwardly, the outer side wall moves outwardly in the same time. The locking plate may escape from the second opening. Lately, the outer side walls may break away from the inner side wall.

Hence, an improved electrical connector with a stable metal shell is desired to overcome the above problems.

BRIEF SUMMARY OF THE INVENTION

According one aspect of the present invention, an electrical connector defining a front mating face and a rear end surface opposited to the mating face, comprising: an insulative housing; a plurality of terminals retained in the insulative housing; and a metal shell covering the insulative housing, and including an inner side wall, a rear wall spaced away from the inner side wall along a front-to-back direction, and an outer side wall bent forwardly from the rear wall and disposed at an outer side of the inner side wall, the inner side wall defining a first locking opening facing toward the rear end surface, a second locking opening facing toward the mating face, the outer side wall defining a retaining plate located within one of the first locking opening and the second locking openings and prevented from escaping from the first and the second openings.

According to another aspect of the present invention, an electrical connector, comprising: an insulative housing; a plurality of terminals retained in the insulative housing and each including a contact portion for mating with a corresponding mating plug, a soldering tail extending out of the insulative housing, and a connect portion connecting with the contact portion and the soldering tail; and a metal shell covering the insulative housing and including a top wall, two inner side walls bent downwardly from two opposite sides of the top wall, a rear wall bent downwardly from a rear side of the top wall and spaced from the inner side wall, and two outer side walls bent forwardly from vertical outer sides of the rear wall and covering the inner side wall, the inner side wall defining an opening passing therethrough, and an inclined extensive plate extending forwardly and outwardly from a rear edge of the opening, the outer side wall defines a retaining hole corresponding to the opening, and a front plate enclosing a front side of the retaining hole; wherein the extensive plate defines a hook bent inwardly from a distal end thereof and hitching the front plate after the hook passes through the retaining hole and when the rear wall of the metal shell is pushed forwardly for preventing the outer side wall from moving forwardly and overly.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
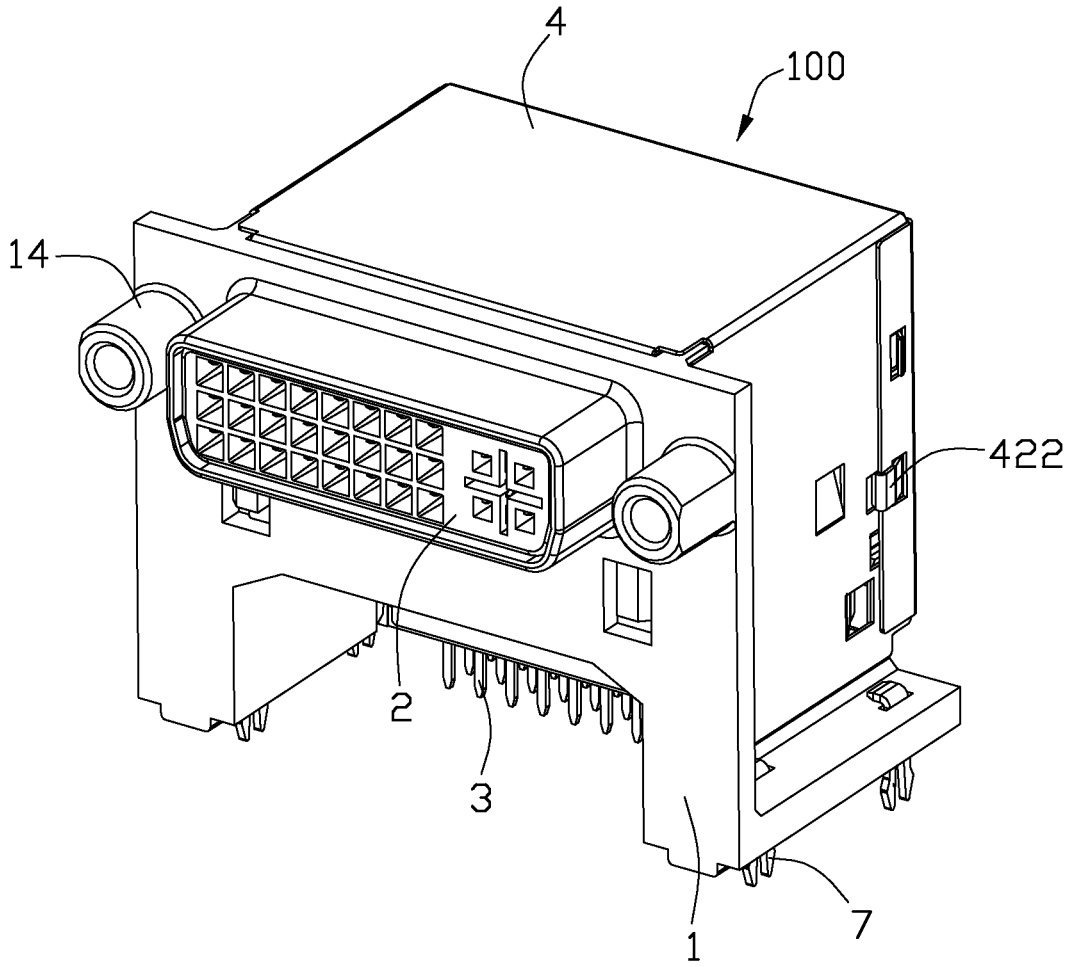
FIG. 1 is a perspective view of an electrical connector according to the present invention.
Figure 2:
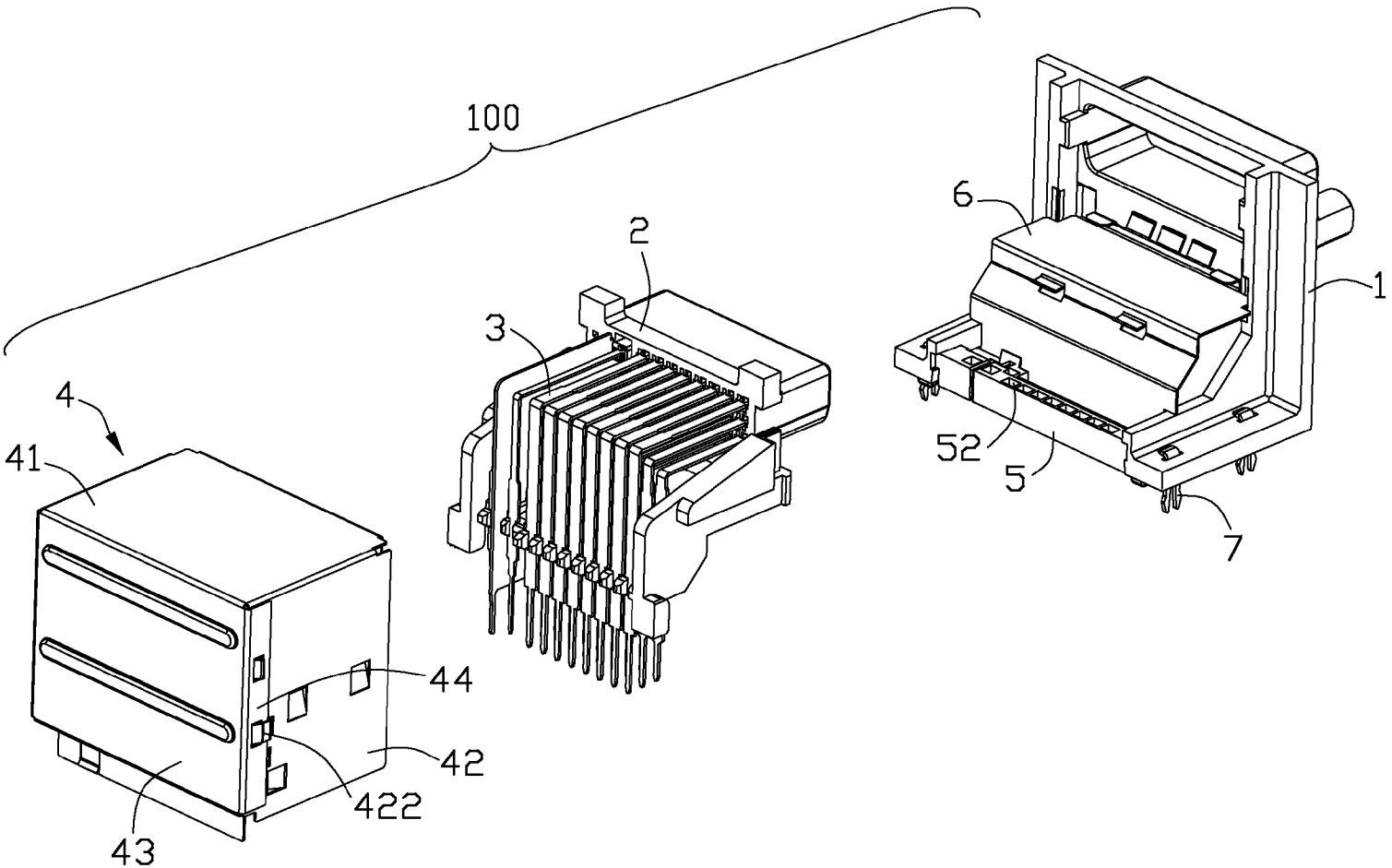
FIG. 2 is a partly exploded view of the electrical connector shown in FIG. 1.
Figure 3:
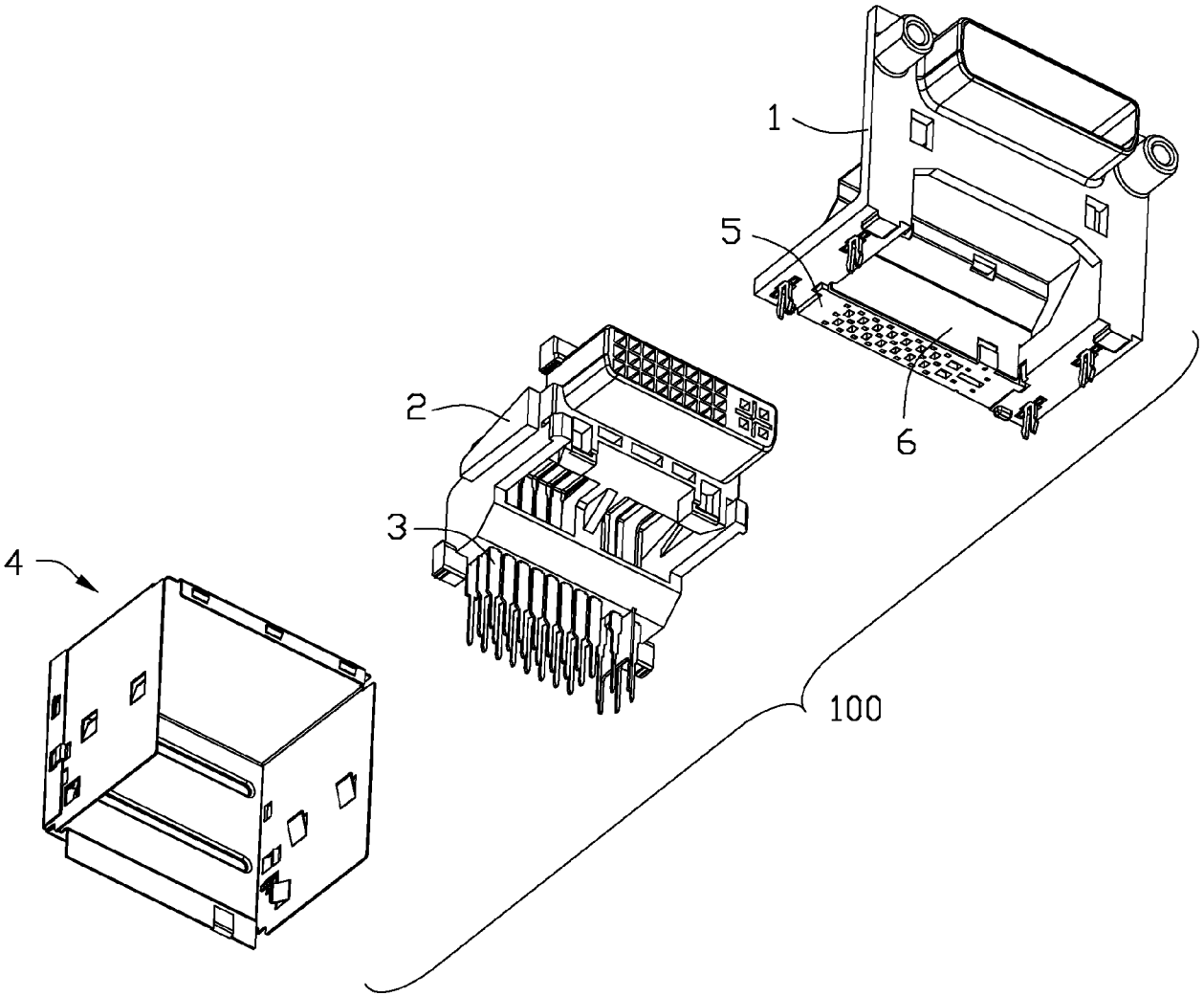
FIG. 3 is a view similar to FIG. 2, while taken from a different aspect.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-7, an electrical connector 100 is preferably a DVI (Digital Visual Interface) connector 100 to be mounted onto a printed circuit board (not shown). The electrical connector 100 comprises a metal bracket 1, an insulative housing 2 retained on the bracket 1, a plurality of terminals 3 received in the insulative housing 2, a metal shell 4 covering the insulative housing 2, a spacer 5 retained on the bracket 1, a metal shielding plate 6, and two pairs of board locks 7 retained on the bracket 1 for retaining the electrical connector 100 on the printed circuit board.

Figure 4:
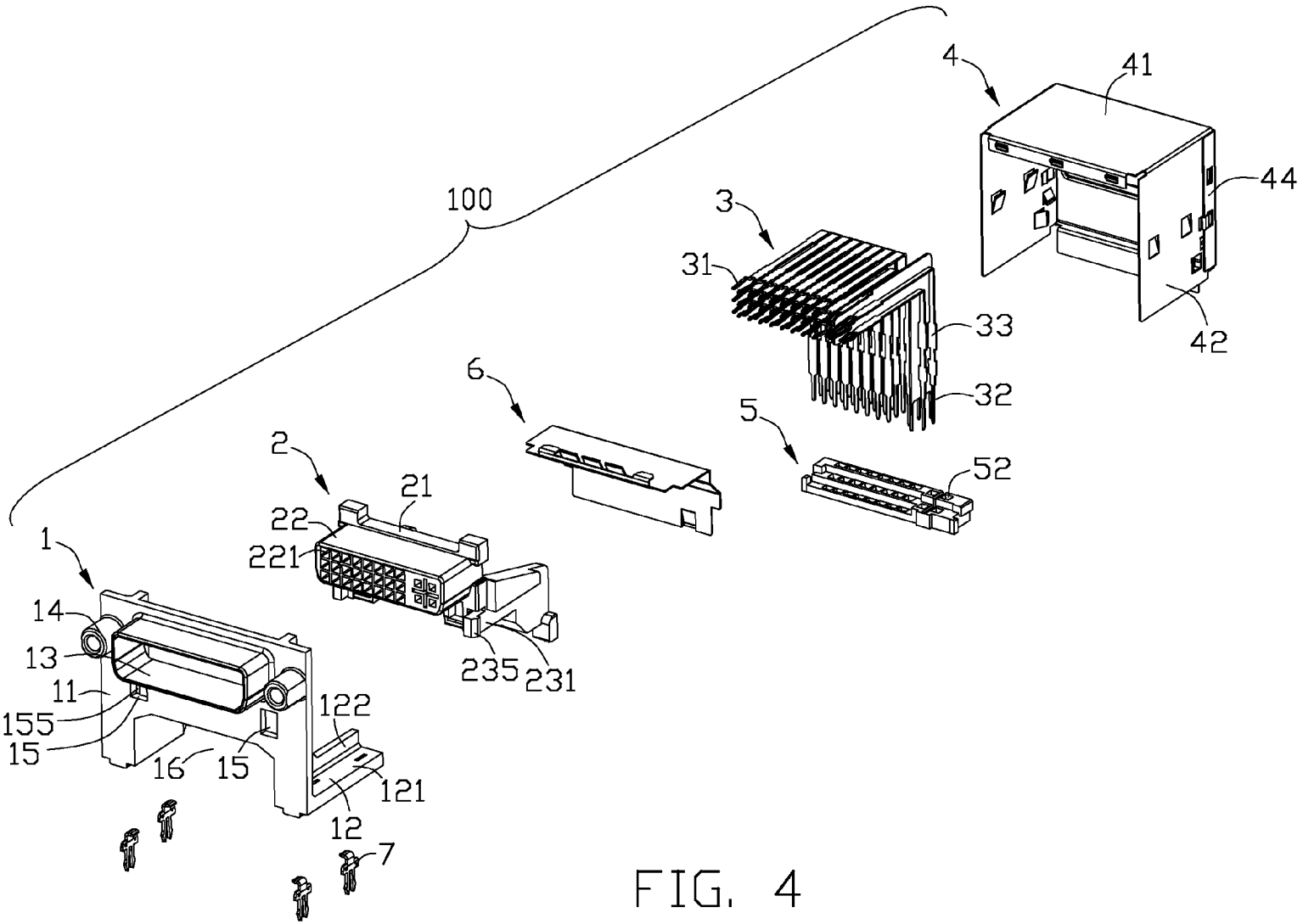
FIG. 4 is an exploded view of the electrical connector shown in FIG. 1.

Referring to FIG. 4, the bracket 1 is presented as a L-shaped in a lateral view, and includes a base portion 11, a pair of level securing portions 12 protruding rearwardly from two opposite side ends of a bottom portion of the base portion 11. The base portion 11 defines a sleeve portion 13 protruding forwardly therefrom, a pair of locking nuts 14 integrally protruding forwardly therefrom for latching a mating plug (not shown), a pair of securing holes 15 and a receiving space 16 all of which pass therethrough along a front-to-rear direction. The sleeve portion 13 is disposed between the locking nuts 14. Conjoined with FIG. 5, two inner side walls of the sleeve portion 13 define two protrusions 132 extending along the front-to-back direction. The receiving space 16 is disposed under the sleeve portion 13 for receiving another connector (not shown).

The securing portions 12 each includes a supporting wall 121 for being mounted onto the printed circuit board, and a vertical wall 122 extending upward from an inner side of the supporting wall 121. The securing walls 121 and the supporting walls 122 connect with the base portion 11 respectively. The board locks 7 are retained on the supporting walls 121 respectively.

The insulative housing 2 includes a body portion 21, a mating portion 22 protruding forwardly from the body portion 21, and a pair of side walls 23 extending rearwardly and downwardly from two opposite sides of the body portion 21. The side walls 23 press downwardly onto the vertical walls 122 of the bracket 1 respectively. Two opposite outer sides of the mating portion 22 define two depressions 222 engaging with the protrusions 132 of the bracket 1 for guiding the mating portion 22 to be inserted forwardly into the sleeve portion 13. The mating portion 22 defines a plurality of passageways 221 passing therethrough for receiving the mating plug. The side walls 23 each defines a locking arm 231 extending forwardly into the securing hole 15 of the bracket 1 and a block 235 on a distal end of the locking arm 231. An inner wall of the securing hole 15 defines another block 155 abutting forwardly against the block 235 of the side wall 23 to prevent the insulative housing 2 from moving rearwardly. The insulative housing 2 further defines a connecting wall 24 connecting the two side walls 23. The connecting wall 24 defines a plurality of recess 242 recessing forwardly from a rear end thereof for retaining the terminals 2.

The terminals 3 each includes a contact portion 31 exposed in the passageway 221 to mate with the mating plug, a vertical soldering tail 32 extending downwardly, and a connecting portion 33 connecting with the contact portion 31 and the soldering tail 32. The connecting portions 33 are securing in the recess 242 of the insulative housing 2.

Figure 5:
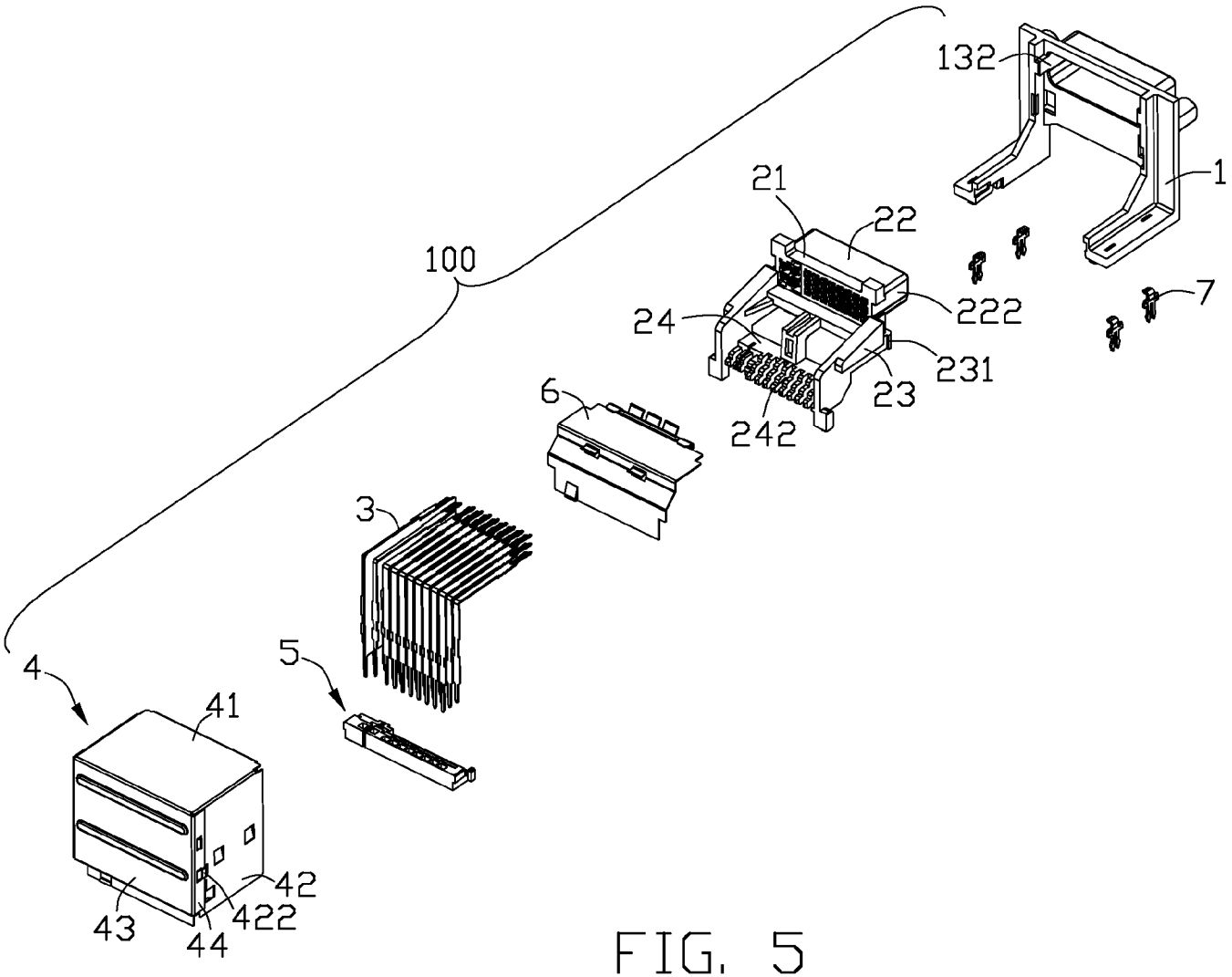
FIG. 5 is a view similar to FIG. 4, while taken from a different aspect.
Figure 6:
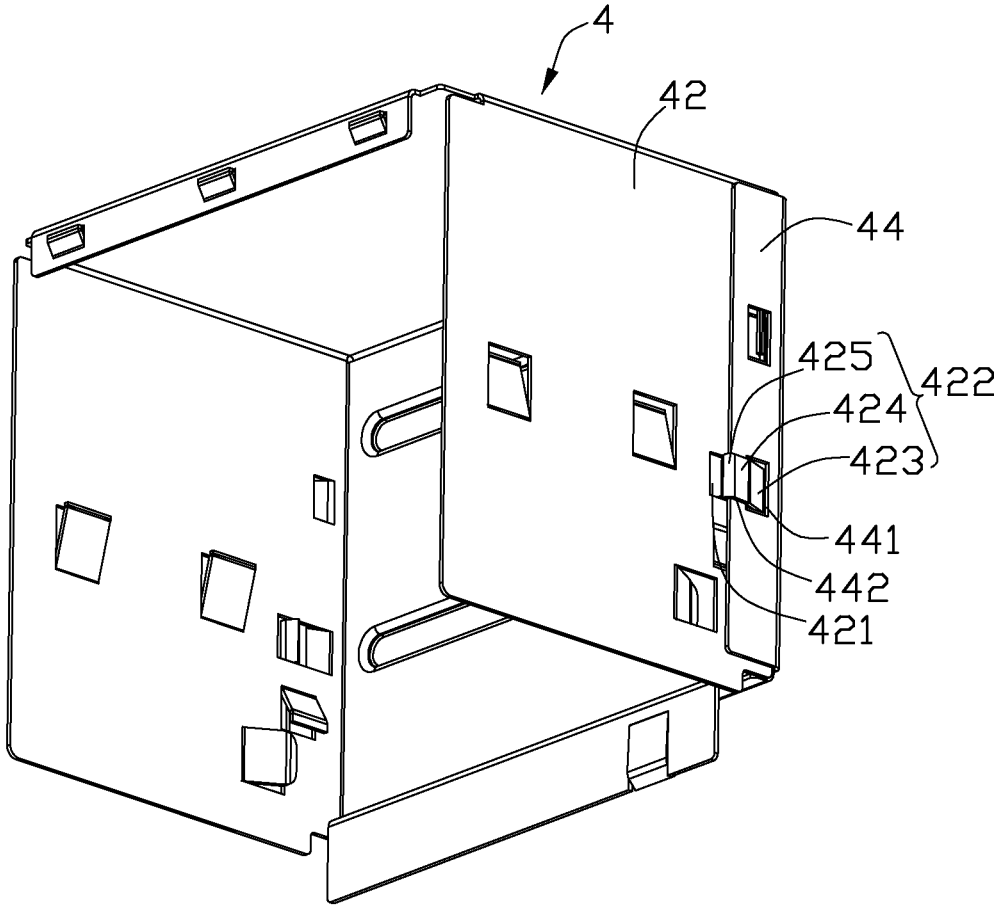
FIG. 6 is a perspective view of a metal shell of the electrical connector shown in FIG. 1.
Figure 7:
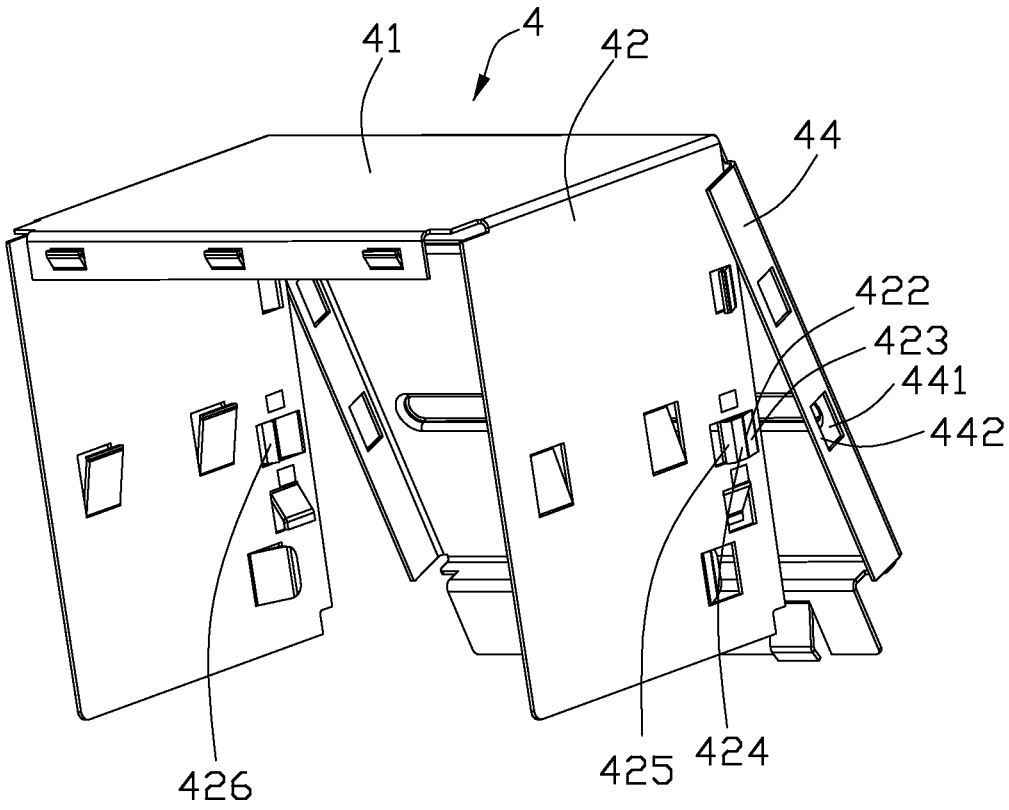
FIG. 7 is another perspective view of the metal shell of the electrical connector, showing a pair of inner side walls of the metal shell not assembled with a pair of outer side walls of the metal shell.

Referring to FIGS. 4-5, the metal shell 4 includes a top wall 41, two opposite inner side walls 42 bent downwardly and vertically from two opposite sides of the top wall 41, a rear wall 43 bent downwardly and vertically from a rear end of the top wall 41, and two opposite outer side walls 44 bent forwardly and vertically from two opposite sides of the rear wall 43. The outer side walls 44 are located at outer sides of the inner side walls 42 and assembled with the inner side walls 42 for preventing the rear wall 43 from moving rearwardly respect to the inner side walls 42. Referring to FIGS. 6-7, The inner side walls 42 each defines an opening 421 passing therethrough, and an inclined extensive plate 422 extending forwardly and outwardly from a rear edge of the opening 421.

The extensive plate 422 includes an inclined plate 423 connecting to the rear edge of the opening 421, and a extending plate 424 extending forwardly from the inclined plate 423 and being parallel to the inner side wall 42, and a hook 425 bent inwardly and rearwardly from a distal end of the extending plate 424. The hook 425 presents as V-shaped or U-shaped from a top view, and defines a tail portion 426 extending into the opening 42. The hook 425 has a first locking opening rearwardly facing toward a rear side of the electrical connector 100. The inclined plate 423 and the inner side wall 42 define a second locking opening facing toward a front side of the electrical connector 100. The first and second locking openings are communicated with each other. The outer side walls 44 each defines a through retaining hole 441 opposited to the opening 421, and a front plate 442 enclosing the retaining hole 441.

Referring to FIG. 4, the spacer 5 is retained on rear ends of the securing portion 12 of the bracket 1, and defines a plurality of through holes 52 through which the soldering tails 32 of the terminals 2 passing.

The shielding plate 6 is secured by the bracket 1 and spacer 5, and located between the terminals 3 and the receiving space 16 of the bracket 1 for decreasing cross-talk of the electrical connector 5 via separate the terminals 3 of the electrical connector 100 from terminals of the another connector received in the receiving space 16.

Be in process of assembling the inner side walls 42 with the outer side walls 44 of the metal shell 4. Firstly, the rear wall 43 is pushed to move forwardly, the outer side walls 44 are driven to move forwardly, the inclined plate 423 and the extending plate 424 guide the front plate 442 of the outer shell 44 in turn to move forwardly. Then, the extensive arm 422 passes through the retaining hole 441 of the outer side wall 44 outwardly. The rear wall 43 has a rearwardly restoring force because the rear wall 43 is bent downwardly from the top wall 41 of the metal shell 4. Thus, the front plate 442 moves automatically and rearwardly into the second locking opening at a position. Lastly, The front plate 442 moves to a rear side of the hook 425. The extending plate 424 abuts inwardly against the front plate 442 to prevent the front plate 442 from moving outwardly. A gap would be formed between the rear wall 43 and the inner side wall 42, the rear wall 43 may move forwardly when the rear wall 43 is hit by an external object by mistake. Then, the front plate 442 may moves in the hook 425 and into the first position at another position, and the hook 425 will abut rearwardly against the front plate 442 to prevent the front plate 442 from further moving forwardly and overly. Thus, the front plate 442 can not break away from the hook 425. and the outer side wall 44 is assembled with the inner side wall 42 reliably. It improve a structure strength of the metal shell 4.

Figure 8:
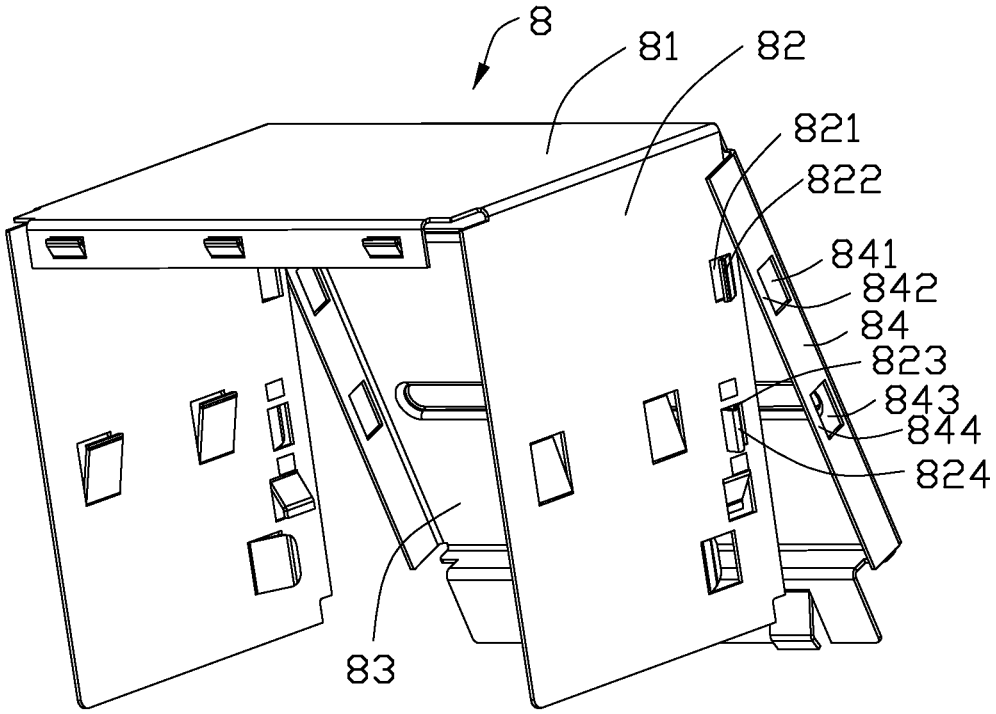
FIG. 8 is a perspective view of an alternative metal shell of the electrical connector.

An alternative embodiment of the metal shell 8 shown in FIG. 8, the metal shell 8 also includes a top wall 81, two opposite inner side walls 82 bent downwardly and vertically from two opposite sides of the top wall 81, a rear wall 83 bent downwardly and vertically from a rear end of the top wall 81, and two opposite outer side walls 84 bending forwardly and vertically from two opposite sides of the rear wall 83. The inner side walls 82 each defines an upper opening 821, an upper extensive plate 822 extending forwardly and outwardly from a rear edge of the upper opening 821, a lower opening 823, and a lower extensive plate 824 extending rearwardly and outwardly from a front edge of the lower opening 823. Distal ends of the upper extensive plate 822 and the lower extensive plate 824 may be intersected with each other in the vertical direction. A first locking opening would be formed between the lower extensive plate 824 and the inner side wall 82 and rearwardly faces to the rear wall 83. A second locking opening would be formed between the upper extensive plate 822 and the inner wall 82 and forwardly faces to a front of the electrical connector 100. The first locking opening and the second locking opening are arranged separated along the front-to-back direction. The first locking opening and the second locking opening also may partially overlap with each other along the front-to-back direction.

The outer side walls 84 each defines a pair of locking holes 841, 843 correspond to the extensive plate 822, 824, and a pair of front plates 842, 844 enclosing the locking holes 841, 843. The upper extensive plate 822 is locked in the upper hole 841 to abut against one front plate 842 for preventing the rear wall 83 from moving rearwardly. The front plates 842, 844 are located between the upper extensive plate 822 and the lower extensive plate 844 along the front-to-back direction. A gap would be formed between the rear wall 83 and the inner side walls 82 along the front-to-back direction. The another front plate 844 would move forwardly to abut against the lower extensive plate 844 while the rear wall 83 is hit by the external object. The front plate 844 can be pressed against by the lower extensive plate 824, and prevented from forwardly and outwardly. The front plate 844 is located in one of the first locking opening and the second locking opening all along. Thus, the outer side wall 84 can not break away from the inner side wall 82.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical connector, comprising:

an insulative housing;

a plurality of terminals retained in the insulative housing and each including a contact portion for mating with a corresponding mating plug, a soldering tail extending out of the insulative housing, and a connect portion connecting with the contact portion and the soldering tail; and a metal shell covering the insulative housing and including a top wall, two inner side walls bent downwardly from two opposite sides of the top wall, a rear wall bent downwardly from a rear side of the top wall and spaced from the inner side wall, and two outer side walls bent forwardly from vertical outer sides of the rear wall and covering the inner side wall, the inner side wall defining an opening passing therethrough, and an inclined extensive plate extending forwardly and outwardly from a rear edge of the opening, the outer side wall defines a retaining hole corresponding to the opening, and a front plate enclosing a front side of the retaining hole; wherein the extensive plate defines a hook bent inwardly from a distal end thereof and hitching the front plate after the hook passes through the retaining hole and when the rear wall of the metal shell is pushed forwardly for preventing the outer side wall from moving forwardly and overly.

2. The electrical connector as claimed in claim 1, wherein the hook presents as U-shaped or V-shaped from a top view.

3. The electrical connector as claimed in claim 1, wherein the hook defines a tail portion extending into the opening of the inner side wall.

4. The electrical connector as claimed in claim 1, wherein the extensive plate includes an extending plate connecting with the inclined plate and the hook, the extending plate presses onto the front plate of the outer side wall and is parallel to the inner side wall.

5. The electrical connector as claimed in claim 1, further comprising a metal bracket, a metal shielding plate and a spacer retained in the bracket, the bracket has a bottom portion defining a receiving space for receiving another electrical connector, the shielding plate is secured by the bracket and the spacer, and located between the terminals and terminals of the another electrical connector for decreasing cross-talk, the spacer defines a plurality of through hole receiving the soldering tails therein, the insulative housing is retained in the bracket, and includes a body portion, a mating portion protruding forwardly, the bracket has a sleeve portion enclosing the mating portion, the contact portions are exposed in the mating portion.

6. An electrical connector comprising:

an insulative housing defining a plurality of exterior faces with a mating port exposed to an exterior in one of said exterior faces;

a plurality of contacts disposed in the housing;

a metallic shell essentially fully enclosing said housing except said one of the exterior faces, said shell defining a two opposite side walls, and directly adjoined first and second wall, the first wall, on two opposite sides, unitarily extending from and directly adjoined with corresponding edges of the two side walls while the second wall being not unitarily extending from and not directly adjoined with corresponding edges of the two opposite side walls but with securing means formed between the second wall and the corresponding side wall; wherein said securing means defines a flange extending from the second wall and covering a corresponding edge region of the corresponding side wall, the flange defining a first opening and the corresponding edge region defining a second opening with an extensive plate unitarily extending from one edge of said second opening, wherein said extensive plate extends through the first opening and defines a folded hook structure at an end to sandwich an edge region of the flange therebetween in a transverse direction.

7. The electrical connector as claimed in claim 6, wherein the edge region of the flange is restricted by said folded hook structure and a root section of the extensive plate in a front-to-back direction perpendicular to said transverse direction.

8. The electrical connector as claimed in claim 6, wherein the first wall is a top wall and the second wall is a rear wall covering top and rear exterior faces of the housing, respectively.

9. An electrical connector, comprising:

an insulative housing with a plurality of terminals retained in the insulative housing; and a metal shell covering the insulative housing and comprising a top wall, two opposite side walls bent downwardly from the top wall, and a rear wall bent downwardly from a rear edge of the top wall, the rear wall having a flange extending forwardly therefrom to cover a rear part of the side wall, wherein the side wall has two openings staggered along a vertical direction, a first extensive plate extending forwardly and outwardly from one of the openings, and a second extensive plate extending rearward and outwardly from the other opening, the first and the second extensive plates together with the side wall define a first and a second locking openings, respectively, which are near to and open to each other as observed from a top view; the flange has a retaining hole and a front plate enclosed the retaining hole, the first extensive plates pass through the retaining hole and bring the front plate of the flange within the first locking opening, so as to prevent the flange from moving rearward, while the second locking opening is located in front of the front plate to prevent the flange from moving forwardly.

10. The electrical connector as claimed in claim 9, wherein the first locking opening and the second locking opening are separately arranged along the front-to-back direction.

11. The electrical connector as claimed in claim 9, wherein the first locking opening and the second locking opening partially overlap with each other along the front-to-back direction.

12. The electrical connector as claimed in claim 9, wherein the front plate moves forwardly to abut against the second extensive plate while the rear wall is hit by the external object.

* * * * *